US006798276B2

(12) United States Patent
Mori et al.

(10) Patent No.: US 6,798,276 B2
(45) Date of Patent: Sep. 28, 2004

(54) REDUCED POTENTIAL GENERATION CIRCUIT OPERABLE AT LOW POWER-SUPPLY POTENTIAL

(75) Inventors: Katsuhiro Mori, Kawasaki (JP); Shinya Fujioka, Kawasaki (JP); Jun Ohno, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/217,408

(22) Filed: Aug. 14, 2002

(65) Prior Publication Data

US 2003/0098739 A1 May 29, 2003

(30) Foreign Application Priority Data

Nov. 29, 2001 (JP) ..... 2001-364683

(51) Int. Cl.[7] ..... G05F 1/10

(52) U.S. Cl. ..... 327/541; 327/543; 323/316

(58) Field of Search ..... 327/538, 540, 327/541, 543, 546; 323/316

(56) References Cited

U.S. PATENT DOCUMENTS

| | | | | | |
|---|---|---|---|---|---|
| 5,317,254 | A | * | 5/1994 | Olson | 323/316 |
| 5,352,935 | A | | 10/1994 | Yamamura et al. | 307/296.4 |
| 5,612,611 | A | | 3/1997 | Drouot et al. | |
| 5,689,460 | A | * | 11/1997 | Ooishi | 365/189.07 |
| 5,717,324 | A | | 2/1998 | Tobita | |
| 5,734,293 | A | * | 3/1998 | Gross | 327/561 |
| 5,892,381 | A | * | 4/1999 | Koifman et al. | 327/198 |
| 5,892,390 | A | | 4/1999 | Tobita | 327/543 |
| 5,936,455 | A | * | 8/1999 | Kobayashi et al. | 327/437 |
| 5,990,711 | A | * | 11/1999 | Sekimoto | 327/112 |
| 6,011,428 | A | | 1/2000 | Tsukude et al. | |
| 6,201,378 | B1 | * | 3/2001 | Eto et al. | 323/313 |
| 6,426,670 | B1 | * | 7/2002 | Tanaka | 327/541 |
| 2002/0008502 | A1 | * | 1/2002 | Akiyama et al. | 323/316 |

FOREIGN PATENT DOCUMENTS

CN 1156271 A 8/1997

OTHER PUBLICATIONS

Carlo Fiocchi, Guido Torelli, Stefano Ghezzi and Marco Maccarrone; *Program Load Adaptive Voltage Generator for Flash Memories*; IEEE Journal of Solid–State Circuits, vol. 32, No. 1, 100–104 (Jan. 1997).

Chinese Office Action for Application No. 02130589.7 dated Apr. 30, 2004 and English translation.

* cited by examiner

*Primary Examiner*—Terry D. Cunningham
(74) *Attorney, Agent, or Firm*—Arent Fox, PLLC

(57) ABSTRACT

A power supply circuit includes a first NMOS-type current mirror circuit which compares a first potential with a second potential, a second NMOS-type current mirror circuit which compares the first potential with a third potential, and a potential setting circuit which adjusts the first potential in response to outputs of the first and second NMOS-type current mirror circuits, such that the first potential falls between the second potential and the third potential.

2 Claims, 4 Drawing Sheets

REDUCED POTENTIAL GENERATION CIRCUIT OPERABLE AT LOW POWER-SUPPLY POTENTIAL

BACKGROUND OF THE INVENTION

1. Field of the Invention

The present invention generally relates to power supply circuits and semiconductor devices, and particularly relates to a power supply circuit for generating an internally reduced potential and to a semiconductor device using such a circuit.

2. Description of the Related Art

In semiconductor devices such as DRAMs, the power supply potential that is supplied from the exterior of the device is internally reduced, thereby driving some circuit elements such as memory core elements by the internally reduced potential.

An internally reduced potential generation circuit that generates the reduced potential typically uses a series of resistors to divide the potential supplied from the external power supply, and sets an upper limit and a lower limit that define a range of the generated reduced potential. The internally reduced potential generation circuit employs a current mirror circuit to control its output potential such that it stays between the upper limit and the lower limit.

FIG. 1 is a circuit diagram showing the configuration of a related-art internally reduced potential generation circuit.

The internally reduced potential generation circuit 10 of FIG. 1 includes PMOS transistors 11 through 14, NMOS transistors 15 through 18, NMOS transistors 21 through 24, PMOS transistors 25 through 27, an inverter 31, a PMOS transistor 32, an NMOS transistor 33, and resistors R1 through R3.

The resistors R1 through R3 are connected in series, thereby forming a potential divider that divides the potential between a potential VF and a potential VSS. The potential VF is generated from an external power supply potential VDD, and is a fixed potential independent of VDD. The potential divider generates a lower-limit reference potential vl as a lower limit of the reduced potential and an upper-limit reference potential vu as an upper limit of the reduced potential.

The PMOS transistors 11 through 14 and the NMOS transistors 15 through 18 together constitute an NMOS-type current mirror circuit that functions as a comparator. The NMOS-type current mirror circuit has an input node that is the gate of the NMOS transistor 15, which receives the lower-limit reference potential vl from the potential divider. The NMOS transistors 21 through 24 and the PMOS transistors 25 through 27 together constitute a PMOS-type current mirror circuit that serves as a comparator. The gate of the PMOS transistor 25 serves as the input node of the PMOS-type current mirror circuit, and receives the upper-limit reference potential vu from the potential divider.

The NMOS-type current mirror circuit on the lower-limit side produces an output that is supplied to the gate of the PMOS transistor 32. The output of the PMOS-type current mirror circuit on the upper-limit side is supplied to the gate of the NMOS transistor 33. The PMOS transistor 32 and the NMOS transistor 33 are connected with each other at their drains, and a reduced potential vp is output from the joint point between these transistors. The generated reduced potential vpr is supplied to internal circuitry of the semiconductor device, and is also fed back to the NMOS-type current mirror circuit on the lower-limit side and the PMOS-type current mirror circuit on the upper-limit side.

The NMOS-type current mirror circuit on the lower-limit side compares the generated reduced potential vpr with the lower-limit reference potential vl. If the reduced potential vpr is below the lower-limit reference potential vl, the NMOS transistor 15 becomes conductive to pull down the potential of a node n0 to LOW. This results in the PMOS transistor 32 being conductive to pull up the reduced potential vpr. If the reduced potential vpr is above the lower-limit reference potential vl, the NMOS transistor 15 becomes nonconductive so as to keep the potential of the node n0 at HIGH, thereby making the PMOS transistor 32 nonconductive.

The PMOS-type current mirror circuit on the upper-limit side compares the generated reduced potential vpr with the upper-limit reference potential vu. If the reduced potential vpr is above the upper-limit reference potential vu, the PMOS transistor 25 becomes conductive to pull up the potential of a node n1 to HIGH. This results in the NMOS transistor 33 being conductive to pull down the reduced potential vpr. If the reduced potential vpr is below the upper-limit reference potential vu, the PMOS transistor 25 becomes nonconductive so as to keep the potential of the node n1 at LOW, thereby making the NMOS transistor 33 nonconductive.

A signal ulp becomes HIGH when the semiconductor device is set in the low power consumption mode. When the low-power-consumption-mode entry signal ulp turns to HIGH, the NMOS transistors 21 and 24 become conductive, and PMOS transistor 27 become nonconductive. As a result, the PMOS-type current mirror circuit on the upper-limit side stops operating. The potential at the node n1 is changed to LOW, which makes the NMOS transistor 33 nonconductive. This prevents a leak current from running from the reduced potential vpr to the ground potential VSS. By the same token, the PMOS transistors 11 and 14 are turned on, and the NMOS transistor 18 is turned off. This changes the potential at the node n0 to HIGH, thereby making the PMOS transistor 32 nonconductive.

By operating as described above, the internally reduced potential generation circuit 10 produces and controls the reduced potential vpr such that the reduced potential vpr falls between the upper-limit reference potential vu and the lower-limit reference potential vl.

Semiconductor devices of today are often provided with an external power supply potential that is set relatively low with an aim of reducing power consumption. The internally reduced potential generation circuit 10 of FIG. 1 uses the PMOS-type current mirror circuit on the upper-limit side. When the external power supply potential VDD is lowered, the difference between the upper-limit reference potential vu and the power supply potential VDD becomes small, resulting in the PMOS transistors 25 and 26 being not fully conductive. As a result, the PMOS-type current mirror circuit on the upper-limit side may not be able to exhibit a sufficient gain.

Accordingly, there is a need for a power supply circuit and a semiconductor device which can properly generate an internally reduce potential even when the external power supply potential is relatively low.

SUMMARY OF THE INVENTION

It is a general object of the present invention to provide a power supply circuit and a semiconductor device that substantially obviate one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a power supply circuit and a semiconductor device particularly pointed out in the specification in such full, clear, concise, and exact terms as to enable a person having ordinary skill in the art to practice the invention.

To achieve these and other advantages and in accordance with the purpose of the invention, as embodied and broadly described herein, a power supply circuit according to the present invention includes a first NMOS-type current mirror circuit which compares a first potential with a second potential, a second NMOS-type current mirror circuit which compares the first potential with a third potential, and a potential setting circuit which adjusts the first potential in response to outputs of the first and second NMOS-type current mirror circuits, such that the first potential falls between the second potential and the third potential.

In the power supply circuit as described above, the potential setting circuit includes a PMOS transistor and an NMOS transistor that are connected in series to form a transistor series between a power supply potential and a ground potential, the output of the first NMOS-type current mirror circuit being coupled to a gate of the PMOS transistor of the transistor series, the output of the second NMOS-type current mirror circuit being coupled to a gate of the NMOS transistor of the transistor series, and the first potential being generated at a joint point between the PMOS transistor and the NMOS transistor of the transistor series.

Further, the power supply circuit as described above further includes a circuit which suspends an operation of the second NMOS-type current mirror circuit in response to assertion of a predetermined signal, and an NMOS transistor which is connected between the ground potential and the gate of the NMOS transistor of the transistor series, and becomes conductive in response to the assertion of the predetermined signal to couple the gate of the NMOS transistor of the transistor series to the ground potential.

The power supply circuit as described above produces and controls the reduced potential (i.e, the first potential) such that the reduced potential falls between the lower-limit reference potential (i.e., the second potential) and the upper-limit reference potential (i.e., third potential). The configuration of the present invention uses an NMOS-type current mirror circuit on the upper-limit side as well as on the lower-limit side, so that the NMOS transistors used in the NMOS-type current mirror circuit can be fully conductive even when the difference between the upper-limit reference potential and the power supply potential becomes small as a result of lowering of the external power supply potential. Accordingly, the NMOS-type current mirror circuit on the upper-limit side can exert a sufficient gain even when the external power supply potential is set to a relatively low potential for the purpose of reducing power consumption.

Further, when a low-power-consumption-mode entry signal (i.e., the predetermined signal) is asserted, the NMOS-type current mirror circuit on the upper-limit side stops operating. When this happens, it is possible that a potential does not sufficiently come down to the LOW level at the gate of the NMOS transistor of the transistor series. In the present invention, an NMOS transistor is provided that becomes conductive in response to the assertion of the low-power-consumption-mode entry signal, thereby bringing the gate potential sufficiently down to the LOW level and turning off the NMOS transistor of the transistor series. This prevents a leak current from running from the reduced potential to the ground potential.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 2:
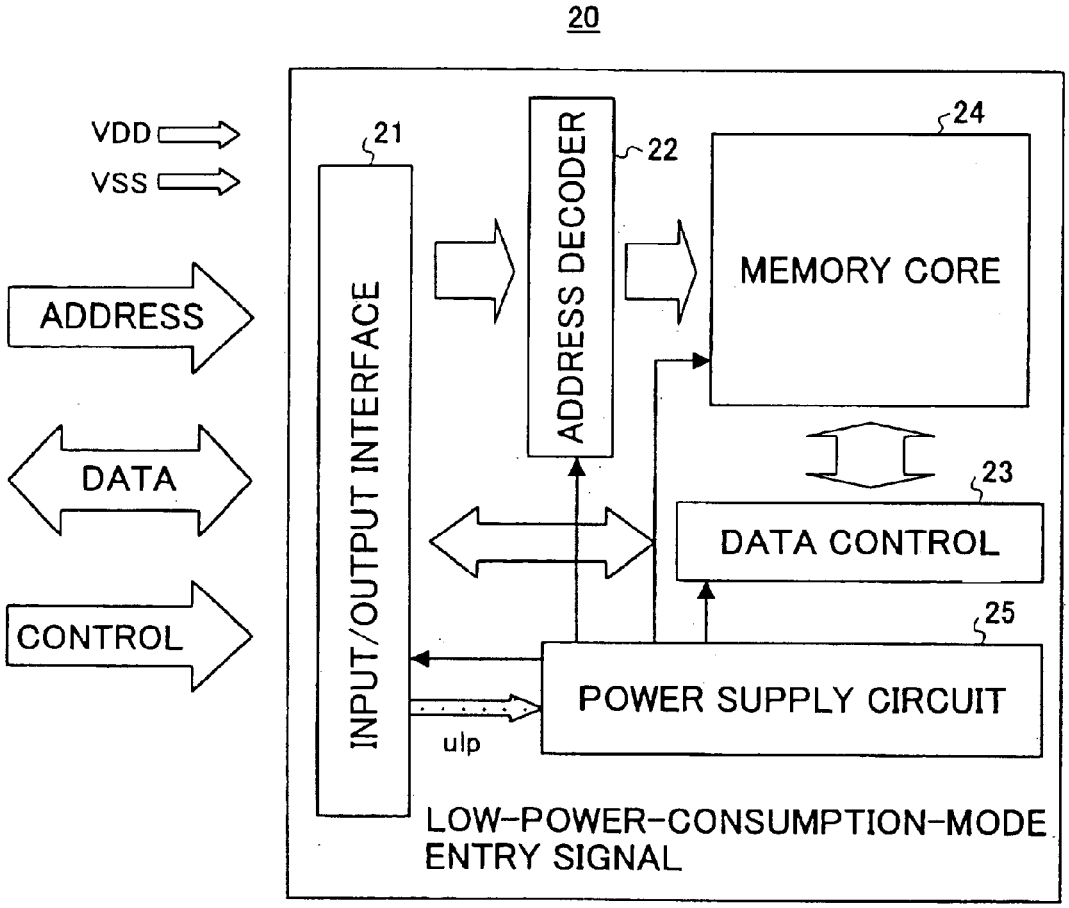
FIG. 2 is a block diagram showing an example of a semiconductor device to which an internally reduced potential generation circuit of the present invention is applied.

FIG. 2 is a block diagram showing an example of a semiconductor device to which an internally reduced potential generation circuit of the present invention is applied. Although FIG. 2 shows a semiconductor memory device as an example of such a semiconductor device, the semiconductor device of the present invention is not limited to a semiconductor memory device.

A semiconductor memory device 20 of FIG. 2 includes an input/output interface 21, an address decoder 22, a data control 23, a memory core 24, and a power supply circuit 25. The input/output interface 21 receives address signals, input data signals, and control signals from the exterior of the device, and supplies output data signals to the exterior of the device. The supplied-address signals are decoded by the address decoder 22.

The memory core 24 includes memory cells, word lines, bit lines, sense amplifiers, etc. In the case of a data read operation, a word line is activated in response to a row address decoded by the address decoder 22, and data are read from the corresponding memory cells to be supplied to the sense amplifiers via the bit lines. Data is read from the sense amplifiers corresponding to a column address decoded by the address decoder 22, and is then supplied to the exterior of the device through the data control 23 and the input/output interface 21.

In the case of a data write operation, a word line is activated in response to a row address decoded by the address decoder 22, and data are read from the corresponding memory cells to be supplied to the sense amplifiers via the bit lines. Thereafter, data is written through the data control 23 in a sense amplifier corresponding to a column address decoded by the address decoder 22, followed by the data of the sense amplifiers being stored or restored in the memory cells.

The power supply circuit 25 includes an internally reduced potential generation circuit of the present invention, and supplies predetermined power supply potentials to various parts of the semiconductor memory device 20. The reduced potential that is generated by the internally reduced potential generation circuit of the power supply circuit 25 is supplied to the memory core 24, for example, and is used as a cell plate potential and as a precharge potential for precharging the bit lines.

The input/output interface 21 asserts the low-power-consumption-mode entry signal ulp when control signals supplied from the exterior of the device indicate entry into the low power consumption mode. In response to the assertion of the low-power-consumption-mode entry signal ulp, the power supply circuit 25 attends to processing such as suspending the supply of power to predetermined units whose operations are suspended among various units of the semiconductor memory device 20.

Figure 3:
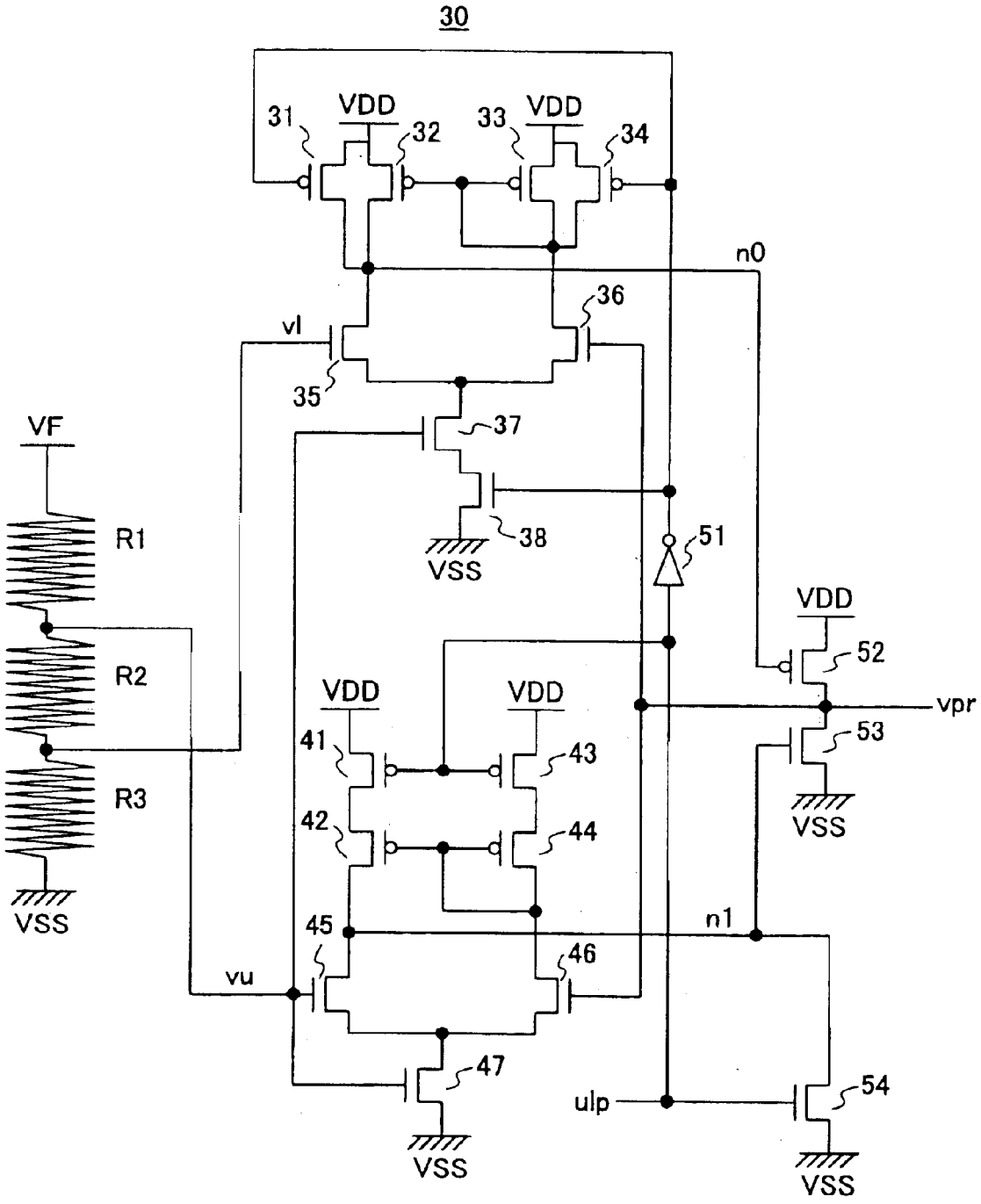
FIG. 3 is a circuit diagram showing the configuration of the internally reduced potential generation circuit according to the present invention.

FIG. 3 is a circuit diagram showing the configuration of the internally reduced potential generation circuit according to the present invention.

The internally reduced potential generation circuit 30 of FIG. 3 includes PMOS transistors 31 through 34, NMOS transistors 35 through 38, PMOS transistors 41 through 44, NMOS transistors 45 through 47, an inverter 51, a PMOS transistor 52, an NMOS transistor 53, and resistors R1 through R3.

The resistors R1 through R3 are connected in series, thereby forming a potential divider that divides the potential between a potential VF and a potential VSS. The potential VF is generated from an external power supply potential VDD, and is a fixed potential independent of VDD. The potential divider generates a lower-limit reference potential vl as a lower limit of the reduced potential and an upper-limit reference potential vu as an upper limit of the reduced potential.

The PMOS transistors 31 through 34 and the NMOS transistors 35 through 38 together constitute an NMOS-type current mirror circuit that functions as a comparator. The NMOS-type current mirror circuit has an input node that is the gate of the NMOS transistor 35, which receives the lower-limit reference potential vl from the potential divider. The PMOS transistors 41 through 44 and the NMOS transistors 45 through 47 together constitute a NMOS-type current mirror circuit that serves as a comparator. The gate of the NMOS transistor 45 serves as the input node of the NMOS-type current mirror circuit, and receives the upper-limit reference potential vu from the potential divider.

In this manner, the present invention employs an NMOS-type current mirror circuit not only on the lower-limit side but also on the upper-limit side.

The NMOS-type current mirror circuit on the lower-limit side produces an output that is supplied to the gate of the PMOS transistor 52. The output of the NMOS-type current mirror circuit on the upper-limit side is supplied to the gate of the NMOS transistor 53. The PMOS transistor 52 and the NMOS transistor 53 are connected with each other at their drains, and a reduced potential vp is output from the joint point between these transistors. The generated reduced potential vpr is supplied to internal circuitry of the semiconductor device, and is also fed back to the NMOS-type current mirror circuit on the lower-limit side and the NMOS-type current mirror circuit on the upper-limit side.

The NMOS-type current mirror circuit on the lower-limit side compares the generated reduced potential vpr with the lower-limit reference potential vl. If the reduced potential vpr is below the lower-limit reference potential vl, the NMOS transistor 35 becomes conductive to pull down the potential of a node n0 to LOW. This results in the PMOS transistor 52 being conductive to pull up the reduced potential vpr. If the reduced potential vpr is above the lower-limit reference potential vl, the NMOS transistor 35 becomes nonconductive so as to keep the potential of the node n0 at HIGH, thereby making the PMOS transistor 52 nonconductive.

The NMOS-type current mirror circuit on the upper-limit side compares the generated reduced potential vpr with the upper-limit reference potential vu. If the reduced potential vpr is above the upper-limit reference potential vu, the NMOS transistor 45 becomes nonconductive so as to keep the potential of a node n1 at HIGH. This results in the NMOS transistor 53 being conductive to pull down the reduced potential vpr. If the reduced potential vpr is below the upper-limit reference potential vu, the NMOS transistor 45 becomes conductive so as to pull down the potential of the node n1 to LOW, thereby making the NMOS transistor 53 nonconductive.

A signal ulp becomes HIGH when the semiconductor device is set in the low power consumption mode. When the low-power-consumption-mode entry signal ulp turns to HIGH, the PMOS transistors 41 and 43 become nonconductive. As a result, the NMOS-type current mirror circuit on the upper-limit side stops operating. When this happens, it is possible that the potential at the node n1 does not sufficiently come down to the LOW level because of the effect of resistance of the NMOS transistor 47. In the present invention, the NMOS transistor 54 is made conductive in response to the HIGH level of the low-power-consumption-mode entry signal ulp so as to bring the potential at the node n1 sufficiently down to the LOW level, thereby turning off the NMOS transistor 53. This prevents a leak current from running from the reduced potential vpr to the ground potential VSS. By the same token, the PMOS transistors 31 and 34 are turned on, and the NMOS transistor 38 is turned off. This changes the potential at the node n0 to HIGH, thereby making the PMOS transistor 52 nonconductive.

In the NMOS-type current mirror circuit on the upper-limit side, it is preferable to make the NMOS transistor 53 completely nonconductive when the reduced potential vpr is lower than the upper-limit reference potential vu. In order to achieve this, the potential at the node n1 needs to be brought down to the VSS level. In the internally reduced potential generation circuit 30 of the present invention shown in FIG. 3, the NMOS transistor 47 is implemented with such characteristics that the NMOS transistor 53 becomes fully nonconductive when the reduced potential vpr is lower than the upper-limit reference voltage vu.

By operating as described above, the internally reduced potential generation circuit 30 produces and controls the reduced potential vpr such that the reduced potential vpr falls between the upper-limit reference potential vu and the lower-limit reference potential vl. The configuration of the present invention uses an NMOS-type current mirror circuit on the upper-limit side in addition to the lower-limit side, so that the NMOS transistors 45 and 46 can be fully conductive even when the difference between the upper-limit reference potential vu and the power supply potential VDD becomes small as a result of lowering of the external power supply potential VDD. Accordingly, the NMOS-type current mirror circuit on the upper-limit side can exert a sufficient gain even when the external power supply potential is set to a relatively low potential for the purpose of reducing power consumption.

Figure 4A:
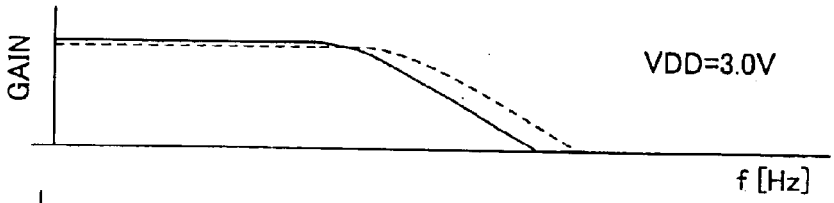
FIGS. 4A through 4C are charts showing characteristics of an NMOS-type current mirror circuit and a PMOS-type current mirror circuit.
Figure 4B:
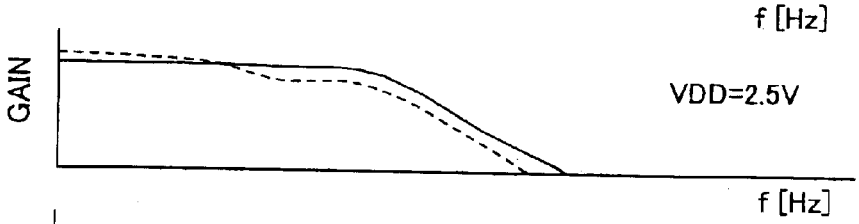
Figure 4C:
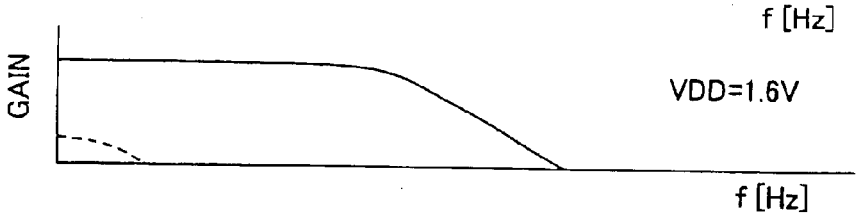

FIGS. 4A through 4C are charts showing characteristics of the NMOS-type current mirror circuit and the PMOS-type current mirror circuit.

FIG. 4A shows frequency characteristics of the gains of the NMOS-type current mirror circuit and the PMOS-type current mirror circuit. The solid line illustrates the gain of the NMOS-type current mirror circuit, and the dotted line shows the gain of the PMOS-type current mirror circuit. As shown in FIG. 4A, these two current mirror circuits exhibit substantially the same gains over the entire frequency range.

FIG. 4B shows a case in which the external power supply potential VDD is 2.5V. The solid line illustrates frequency characteristics of the gain of the NMOS-type current mirror circuit, and the dotted line shows frequency characteristics of the gain of the PMOS-type current mirror circuit. As shown in FIG. 4A and FIG. 4B, the gain of the PMOS-type current mirror circuit slightly drops in the high frequency region when the power supply potential VDD is lowered. In comparison with the NMOS-type current mirror circuit, however, no more than a slight degradation is observed.

Figure 1:
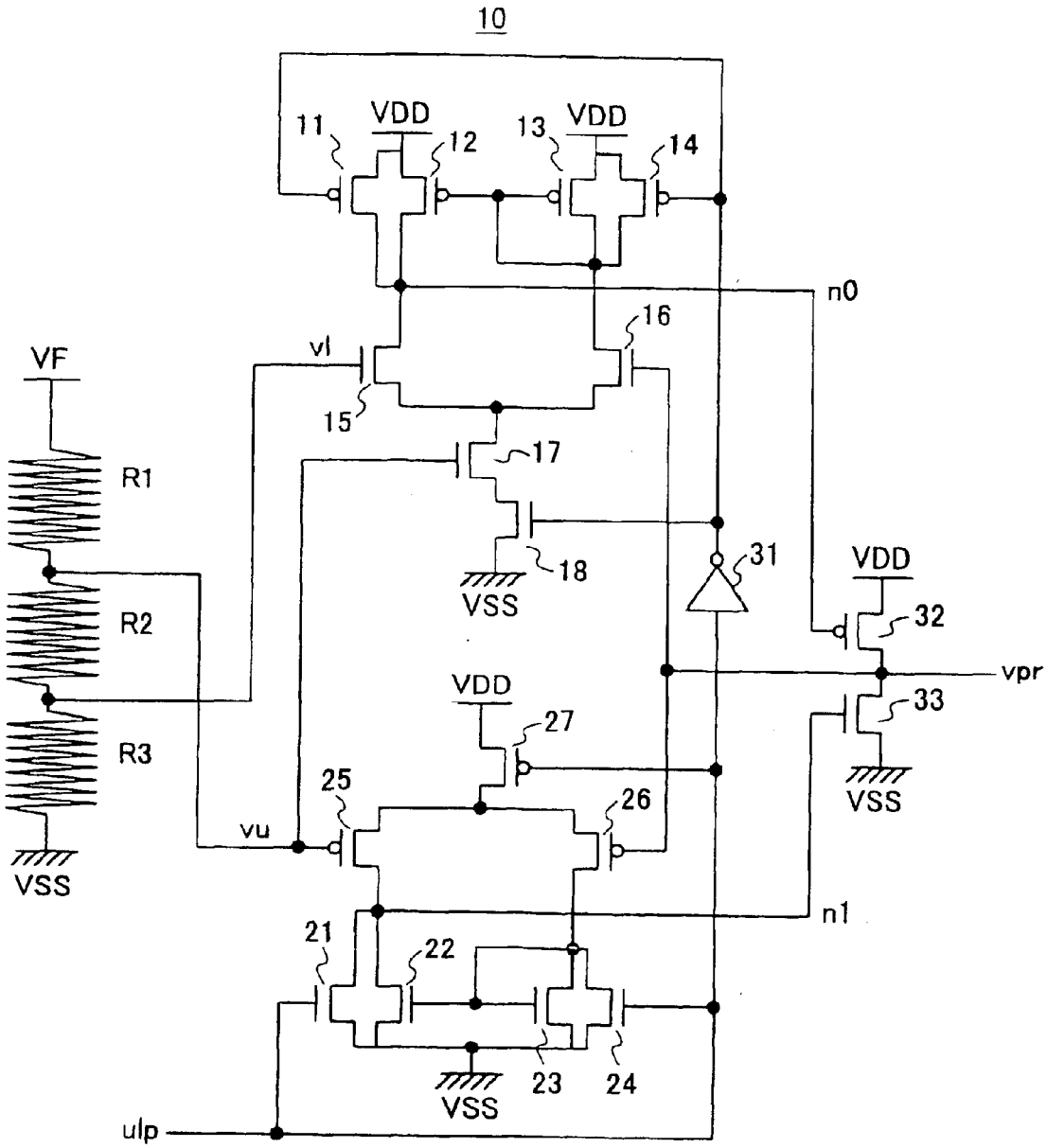
FIG. 1 (PRIOR ART)
FIG. 1 is a circuit diagram showing the configuration of a related-art internally reduced potential generation circuit.

FIG. 4C shows a case in which the external power supply potential VDD is 1.6V. The solid line illustrates frequency characteristics of the gain of the NMOS-type current mirror circuit, and the dotted line shows frequency characteristics of the gain of the PMOS-type current mirror circuit. As shown in FIG. 4C, the gain of the PMOS-type current mirror circuit substantially drops across the entire frequency region in comparison with the NMOS-type current mirror circuit when the power supply potential VDD is lowered. In such condition of the power supply potential, the internally reduced potential generation circuit 10 of FIG. 1 cannot properly operate to produce an adequate reduced potential vpr.

The internally reduced potential generation circuit of the present invention uses an NMOS-type current mirror circuit for both the upper-limit side and the lower-limit side. With this provision, the internally reduced potential generation circuit can properly operate to produce a reduced potential vpr even when the external power supply potential VDD drops to around 1.6 V as shown in FIG. 4C.

Further, the present invention is not limited to these embodiments, but various variations and modifications may be made without departing from the scope of the present invention.

The present application is based on Japanese priority application No. 2001-364683 filed on Nov. 29, 2001, with the Japanese Patent Office, the entire contents of which are hereby incorporated by reference.

What is claimed is:

1. A power supply circuit, comprising:

a first NMOS-type current mirror circuit, which compares a first potential with a second potential; and a second NMOS-type current mirror circuit which compares the first potential with a third potential; and a potential setting circuit which adjusts the first potential in response to outputs of the first and second NMOS-type current mirror circuits, such that the first potential falls between the second potential and the third potential, wherein said first NMOS-type current mirror circuit includes:

an NMOS transistor that receives the first potential at a gate thereof; and an NMOS transistor that receives the second potential at a gate thereof, and wherein said second NMOS-type current mirror circuit includes:

an NMOS transistor that receives the first potential at a gate thereof; and an NMOS transistor that receives the third potential at a gate thereof, wherein said potential setting circuit includes PMOS transistor and an NMOS transistor that are connected in series to form a transistor series between a power supply potential and a ground potential, the output of said first NMOS-type current mirror circuit being coupled to a gate of the PMOS transistor of said transistor series, the output of said second NMOS-type current mirror circuit being coupled to a gate of the NMOS transistor of said transistor series, and said first potential being generated at a joint point between the PMOS transistor and the NMOS transistor of said transistor series, said power supply circuit further comprising:

a circuit which suspends an operation of said second NMOS-type current mirror circuit in response to assertion of a predetermined signal; and an NMOS transistor which is connected between the ground potential and the gate of the NMOS transistor of said transistor series, and becomes conductive in response of the assertion of the predetermined signal to couple the gate of the NMOS transistor of said transistor series to the ground potential.

2. A semiconductor device, comprising:

a power supply circuit which generates a first potential; and an internal circuit which is driven by the first potential, wherein said power supply circuit includes:

a first NMOS-type current mirror circuit which compares a first potential with a second potential;

a second NMOS-type current mirror circuit which compares the first potential with a third potential; and a potential setting circuit which adjusts the first potential in response to outputs of the first and second NMOS-type current mirror circuits, such that the first potential falls between the second potential and the third potential, wherein said first NMOS-type current mirror circuit includes:

an NMOS transistor that receives the first potential at a gate thereof; and an NMOS transistor that receives the second potential at a gate thereof, and wherein said second NMOS-type current mirror circuit includes:

an NMOS transistor that receives the first potential at a gate thereof; and an NMOS transistor that receives the third potential at a gate thereof, wherein said potential setting circuit includes a PMOS transistor and an NMOS transistor that are connected in series to form a transistor series between a power supply potential and a ground potential, the output of said first NMOS-type current mirror circuit being coupled to a gate of the PMOS transistor of said transistor series, the output of said second NMOS-type current mirror circuit being coupled to a gate of the NMOS transistor of said transistor series, and said first potential being generated at a joint point between the PMOS transistor and the NMOS transistor of said transistor series, said semiconductor device further comprising:

a circuit which asserts a predetermined signal in response to setting of a low power consumption mode;

a circuit which suspends an operation of said first NMOS-type current mirror circuit and said second NMOS-type current mirror circuit in response to the assertion of the predetermined signal; and an NMOS transistor which is connected between the ground potential and the gate of the NMOS transistor of said transistor series, and becomes conductive in response to the assertion of the predetermined signal to couple the gate of the NMOS transistor of said transistor series to the ground potential.

* * * * *